US007810747B2

(12) United States Patent
Allaire et al.

(10) Patent No.: US 7,810,747 B2
(45) Date of Patent: Oct. 12, 2010

(54) INDUCER COMMINUTOR

(75) Inventors: Jason Douglas Allaire, Methuen, MA (US); Donald Paul Russell, Kingston, NH (US)

(73) Assignee: Lawrence Pumps, Inc., Lawrence, MA (US)

( * ) Notice: Subject to any disclaimer, the term of this patent is extended or adjusted under 35 U.S.C. 154(b) by 0 days.

(21) Appl. No.: 12/245,038

(22) Filed: Oct. 3, 2008

(65) Prior Publication Data

US 2009/0090798 A1 Apr. 9, 2009

Related U.S. Application Data

(60) Provisional application No. 60/977,130, filed on Oct. 3, 2007.

(51) Int. Cl.
*B02C 23/36* (2006.01)
*B02B 1/00* (2006.01)
*B07B 4/00* (2006.01)

(52) U.S. Cl. ..... 241/46.06; 241/241; 241/260.1; 241/261

(58) Field of Classification Search ..... 241/241, 241/260.1, 261.1, 46.06, 65, 261
See application file for complete search history.

(56) References Cited

U.S. PATENT DOCUMENTS 2,902,227 A 9/1959 Higer
4,838,759 A 6/1989 Dunn et al.
4,911,368 A 3/1990 Nishimori
4,938,426 A * 7/1990 Koenig ..... 241/222
4,993,649 A * 2/1991 Koenig ..... 241/224
5,443,214 A * 8/1995 Lesar ..... 241/82.2
5,460,482 A 10/1995 Dorsch
5,704,555 A * 1/1998 Arastoopour ..... 241/16
5,743,471 A * 4/1998 Ivanov ..... 241/16
5,791,572 A * 8/1998 Fernlund ..... 241/260.1
6,149,083 A * 11/2000 McFarland ..... 241/82.5
6,190,121 B1 2/2001 Hayward et al.
6,224,331 B1 5/2001 Hayward et al.
6,325,307 B1 * 12/2001 Nikolskii et al. ..... 241/23
6,379,127 B1 4/2002 Andrews et al.
6,505,550 B2 * 1/2003 Hamilton ..... 100/148
6,759,774 B1 7/2004 Griggs
7,207,767 B2 4/2007 Ashihara et al.

(Continued)

OTHER PUBLICATIONS

PCT Search Report dated Dec. 1, 2008 of Patent Application No. PCT/US2008/078706 filed Oct. 3, 2008.

*Primary Examiner*—Bena Miller
(74) *Attorney, Agent, or Firm*—Vern Maine & Associates

(57) ABSTRACT

A device for reducing solids and increasing pressure in a fluid handling system has comminution and inducer sections in a housing upstream of a pump impeller. A rotor has a hub with a small inlet diameter and a larger outlet diameter and a helical rotor blade with its blade pitch angle progressively increasing from inlet to outlet as a polynomial function. The comminutor section has a larger diameter than the inducer section and comminutor vanes extending inward forming a vane edge effective diameter equal to the inducer section diameter. The rotor blade turning within the closing fitting cage of vane edges provides a crushing and shearing action to solids in the fluid flow. Cutouts on the blade edge provide additional crushing and shearing action against the vanes. The fluid passageway sectional area at the outlet is bigger than the throat of the downstream main impeller.

20 Claims, 2 Drawing Sheets

U.S. PATENT DOCUMENTS

| | | | |
|---|---|---|---|
| 7,239,056 | B1 | 7/2007 | Griggs et al. |
| 7,341,436 | B2 | 3/2008 | Andrews |
| 2003/0015613 | A1 | 1/2003 | Yamamoto |
| 2005/0053494 | A1 | 3/2005 | Andrews |
| 2006/0169811 | A1 | 8/2006 | Kim |
| 2008/0267773 | A1 | 10/2008 | Andrews |

* cited by examiner

INDUCER COMMINUTOR

This invention claims priority for all purposes to U.S. application Ser. No. 60/977,130 filed Oct. 3, 2007.

BACKGROUND OF INVENTION

1. Field of the Invention

The invention relates to a helical-axial inducer/comminution device for solids-ladened fluid flow systems; and more particularly to an inducer/comminution device for a rotary kinetic pump in a fluid flow.

2. Background of the Invention

Many industrial processes involve the conveyance of fluid streams by centrifugal pumps. Often these fluid streams carry or contain solids, pieces of relatively solid material, that are too large to pass through the pump impeller passages or the passages in downstream process equipment. Rotary comminution devices are often utilized to reduce the size of solids to a size which can be passed by downstream pumps and equipment. Typically a solids-laden fluid stream is routed through an upstream rotary comminution device enroute to further processing.

The helical-axial comminutor is one such type of equipment that has been developed to reduce solids to a size that can be passed by pumps and downstream equipment. Another type of comminutor utilizes rotary radial cutter blades passing in close proximity to a stator to comminute solids. The problem with existing helical-axial and rotary comminutors is that they obstruct flow to the pump thereby creating the potential for cavitation in pump applications that have limited Net Positive Suction Head (NPSH) available to the pump.

When pumping fluids where NPSH availability is limited, helical-axial inducers are often applied to centrifugal pumps to boost pressure to the pump inlet so as to avoid cavitation. Inducers increase the pressure of the liquid at the impeller eye by accelerating liquid such that cavitation occurs on the inducer while meeting the impeller requirements for fluid flow. The sectional area normal to the meridional plane of an inducer throat is generally larger than that of the throat of the downstream impeller passage. The throat is defined as the section along the meridional axis with the smallest distance between any two opposing surfaces. Although inducers are effective at forestalling the onset of impeller cavitation, solids that pass through an inducer may still become lodged in the downstream impeller.

In summary, helical-axial inducers that are effective at reducing cavitation are not effective at solids reduction, and helical-axial and radial comminutors, although effective at solid size reduction, create a pump inlet obstruction to flow thereby increasing the likelihood of cavitation.

SUMMARY OF INVENTION

In one aspect, the invention relates to a rotary inducer comminutor device for a solids-bearing fluid handling system, that will reduce solids to a size that will pass through downstream impeller passages and that acts as an inducer to increase the pressure available to the downstream impeller inlet.

To this end, one embodiment of the present invention is an in-line device that combines comminution functionality with inducer functionality. It has a rotatable component disposed within a stationary component. It is positioned in the fluid flow upstream of a main pump impeller. It may have its rotational axis aligned with the main pump impeller. It may be rotatable by the same shaft at the same rotative speed as the main pump impeller. The rotatable component may have a hub extending from an outlet or fluid discharge end to an inlet end, with helically arranged rotor blade or set of rotor blades disposed on the hub that function as a screw in pushing fluid through the device towards the main pump impeller inlet. The meaning of the terms "outlet" and "inlet" as used throughout this disclosure are properly interpreted as relative to the direction of fluid flow and may be specific with respect to axial location, to the particular component being referenced, all as should be readily apparent from the context.

The hub may have a larger diameter at the outlet than the hub diameter at the inlet. The change in diameter of the hub from the inlet to the outlet may be describable by a first polynomial function. The rotor blade set may be one or a plurality of helical blades, of tapered or uniform width. Blades may be relatively longer, as of more than one full helix or full turn around the hub; or they may be shorter, as of only a small degree of helix extending only a partial turn around the hub, distributed axially along the hub with staggered leading and trailing edges. One or more of the blades may be configured with one or more cut-outs on its outboard edge including at its leading edge. The cut-outs may be step-shaped and may be located axially along the blade edge, uniformly or non-uniformly spaced between the inlet and the outlet.

Each blade may have an inlet end, blade pitch angle of attack and an outlet end blade pitch trailing angle, with the blade pitch angle progressively increasing or otherwise changing from a low inlet pitch angle to a relatively higher outlet pitch angle as a second polynomial function. Rotor fluid passages are formed by the space between adjacent blades or adjacent turns of the blade, and the hub.

The rotatable component may be disposed coaxially within the stationary component, which may be a housing configured with or as an inducer section and a comminutor section. The inducer section may be upstream of the comminutor section. The comminutor section may have a larger inside diameter or maximum interior diameter than the inducer section. The comminutor section may have a larger diameter than the outlet end of the helical-axial device or rotor, and have one or more comminutor vanes extending radially inward from the wall of the comminutor section to the same diameter as the diameter of the adjacent inducer section. Fluid passages are formed by adjacent comminutor vanes and the wall or liner of the comminutor section.

Structures equivalent to the described vaned comminutor section, within the scope of the invention, include a comminutor section of the same diameter as the inducer section but configured with a series of longitudinal or helically configured slots or channels of which the walls function as vanes. Helically configured vanes, slots, or channels in the comminutor section effectively increase its diameter, provide the aforementioned fluid passages, and may have a pitch angle describable as a third polynomial function, with a direction of rotation the same or different than that of the rotor blades.

The rotor and housing may be assembled such that the inlet end of the rotor is positioned within the inducer section of the housing and the outlet end of the rotor is positioned in the comminutor section of the housing whereby the rotor outlet blade diameter fits closely within the comminutor section vane diameter such that the combined sectional area of inducer section fluid passage and comminutor section fluid passage measured on a plane normal to the meridional plane, at the discharge end of the rotary inducer comminutor device is greater than that of the throat of the downstream impeller passage, but with the sectional area of any one fluid passage of the device measured individually being less than the throat area of the downstream impeller passage. Furthermore, the blade pitch angle and other characteristics of the rotor at the outlet of the inducer section is by design such that the total volumetric flow rate exiting the inducer comminutor device is equal to or greater than the flow requirements of the downstream impeller.

Other goals and objectives of the invention will be readily apparent from the figures and detailed description that follows.

DETAILED DESCRIPTION OF THE INVENTION

The invention is susceptible of numerous embodiments. What is described here and shown in the figures is intended to be illustrative but not limiting of the scope of the invention.

Figure 1:
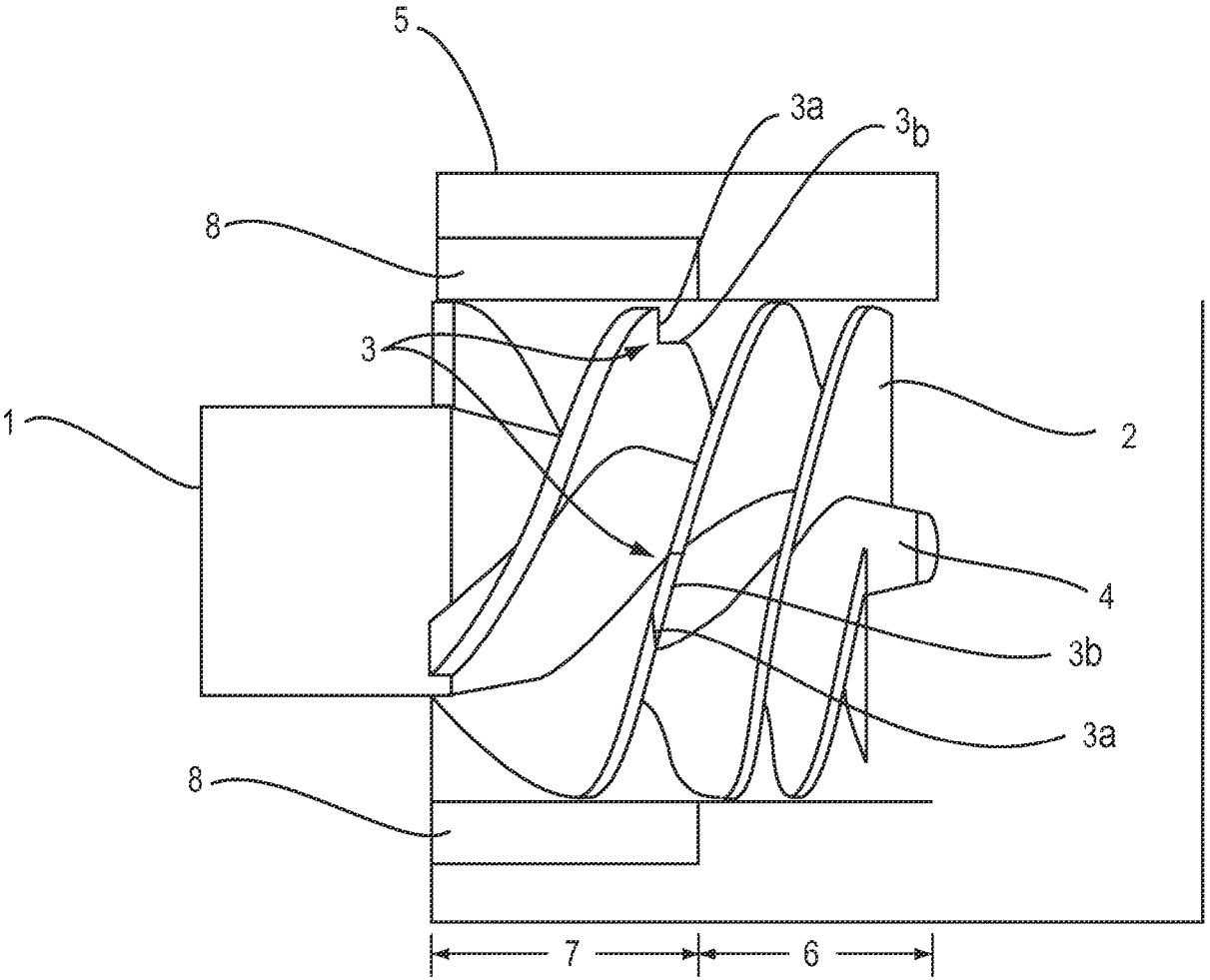
FIG. 1 is a side elevation view of one embodiment of the invention, illustrating a rotary component mountable on a shaft end within a housing, the rotary component having a hub with a hub outer diameter expanding from its inlet end to its outlet end, with helical rotor blades disposed on the hub having a pitch angle running from a fine pitch at the inlet end to a more course pitch at the outlet end and further configured with step cut-outs at their outboard edges that are axially aligned with vanes in a comminutor section of the housing.

Referring to FIG. 1, there is illustrated an embodiment of the invention in which rotor (1) is disposed upstream of a main pump impeller (not shown) with its rotational axis aligned with the main pump impeller. Rotor (1) is mounted on the distal end of the pump shaft (not shown) and is rotatable by the shaft at the same rotative speed as the main pump impeller. In other embodiments, the rotor may be mounted by either end, on a different shaft, rotating at the same or a different speed. A plurality of helical blades (2), in this embodiment a quantity of three, although there may be greater or fewer than three, extend helical-axially along the longitudinal axis of rotor (1). Each blade has, with respect to the axial direction of fluid flow, an inlet end angle of attack or inlet angle and a trailing edge blade angle or outlet angle which may be greater than the inlet end blade angle. Rotating blade pitch angle is measured with respect to a plane normal to the axis of rotation at the point of measurement; small equating to fine pitch, larger equating to relatively coarser pitch.

In this embodiment, blades (2) incorporate one or more step cut-outs (3) on the outside diameter or outer edge of the blades. Cut-outs (3) are located axially between the inlet and outlet ends of the blades; there being in this embodiment one cut-out disposed on the outer edge of each blade at about the half way point. Other embodiments may have more cut-outs. The size of all or individual cutouts may be larger or smaller than illustrated. The shape of the cut-outs in this embodiment is generally two sided as a V shaped slot; with one side or edge (3*a*) being presented as a radially oriented striking or cutting edge to rotary fluid flow and any solids therein, and the other side or edge (3*b*) being a trailing edge with respect to rotary fluid flow. The striking edge (3*a*) may be hardened or otherwise configured to be resistant to wearing from the impact of solids in the fluid stream. The inlet angle of blades (2) is less than the discharge or outlet angle of blades (2), tending to cause acceleration of fluid velocity and/or increase of fluid pressure at the outlet with respect to the inlet, thereby tending to induce cavitation within the rotor section and reduce cavitation in the proximate downstream main pump impeller. The change in blade angle of blades (2) from inlet to outlet follows a polynomial function.

Hub (4) is integral to rotor (1) and is characterized by a larger diameter at the outlet than the diameter at the inlet. The change of hub (4) diameter from the inlet of blades (2) to the outlet of blades (2) is characterized by another polynomial function.

Housing (5) incorporates an inducer section (6) upstream of a comminutor section (7). Rotor (1) is disposed within the housing such that it extends through comminutor section (7) well into inducer section (6). Comminutor section (7) has a larger average diameter than does inducer section (6), in this embodiment being a constant diameter (7*d*) as illustrated in FIG. 2A. There are one or more comminutor vanes (8), typically multiple vanes uniformly distributed around the perimeter, in the comminutor section (7), extending more or less axially, although there may be a helical component to their shape and orientation in one direction or another, along the longitudinal axis of comminutor section (7) and extending radially inward from the inside wall of the comminutor section to an inlet end effective vane diameter, illustrated as diameter (8*d*) in FIG. 2A, equal to the outlet end diameter of adjacent inducer section (6).

The vanes may be fabricated of hardened materials or have hardened edges. The vane diameter may vary over the length of the comminutor section from that of the inducer section, so long as it closely corresponds for shearing action to the diameter of the rotor blade set, without detracting from the invention. Vane pitch angle is measured with respect to a plane normal to the axis of the device, at the axial point of measurement; a small angle equating to fine pitch, a larger angle equating to relatively coarser pitch.

Referring to FIGS. 1 and 2A, rotor (1) is coaxial with housing (5) and is longitudinally positioned within housing (5) such that the upstream end of rotor (1), in particular the outboard edge or diameter of blades (2), is in radially in close proximity to the wall of inducer section (6) of housing (5). The diameter of rotor (1), defined by the arc of rotation of the outboard edge of blades (2), is in radially close proximity to the vane diameter (8*d*) of comminutor section (7), or put another way, in this embodiment the diameter of rotor (1) is slightly less than the inducer diameter of housing (5) and is constant over the length of the rotor. In other embodiments, rotor blade width may be constant and rotor diameter may vary similarly with hub diameter.

Step cut-outs (3) are axially positioned on blades (2) to rotate within the length of and in close proximity to comminutor vanes (8) in order to provide opposing surfaces for reducing solids with additional crushing and/or shearing action against vanes (8) as is further described below.

In operation, the volumetric flow rate of fluid entering the inlet of rotor (1) is determined by the angle of attack of the leading edge of blades (2), the rotational speed of rotor (1), and the cross sectional area of the annulus formed by hub (4) and the inside diameter of inducer section (6) of housing (5) taken on a plane normal to the axis of rotation of rotor (1) at the inlet end of blades (2). Fluid is accelerated both by the increasing pitch angle of blades (2) and the reduction in the sectional area of the inducer fluid passage caused by the hub (4) changing diameter as a polynomial function from inlet to outlet, such that mass flow is held constant. Fluid is restricted from recirculating back to the eye by the close radial proximity of the rotor diameter of blades (2) to the wall of inducer section (6). If the localized pressure of the fluid at any point along the meridional axis of the rotor (1) drops below the fluid vapor pressure, cavitation will occur, but remaining fluid will continue to flow within the inducer passage. The non-cavitating mass flow rate exiting the device will be at or above the mass flow rate required by the main pump impeller downstream of the rotor (1), thereby forestalling cavitation within the main pump impeller. Because cavitation occurs in the inducer section while allowing fluid flow, cavitation at the main pump that would otherwise occur can be reduced or avoided.

Solids borne by fluid flow enter the inlet of rotor (1) and follow the fluid flow path between hub (4) of rotor (1) and the wall of the inducer section (6) to comminutor section (7). Solids entering comminutor section (7) will tend to be moved by fluid flow and inertia radially outward into the annulus formed by the diameter of rotor (1) and the full diameter (7*d*) of the comminutor section. The rotation of rotor (1) causes a shearing action of the rotor blades (2) relative to the comminutor vane(s) (8). Solids become trapped against comminutor vane(s) (8) and are reduced by the shearing action of vanes (2). Moreover, in this embodiment, some solids will be captured by step cut-outs (3) during the rotating action fluid flow, where the riser of the step shape, the leading or striking edge (3*a*) of step cut-outs (3), will also rotatably engage solids and drive them to fracture against comminutor vanes (8). This process of solids fracture by blades (2) and cut-outs (3) against vanes (8) will repeat with rotation of the rotor until solids are small enough to exit the rotor (1) and comminutor section (7) outlet with the continuous fluid flow.

Figure 2B:
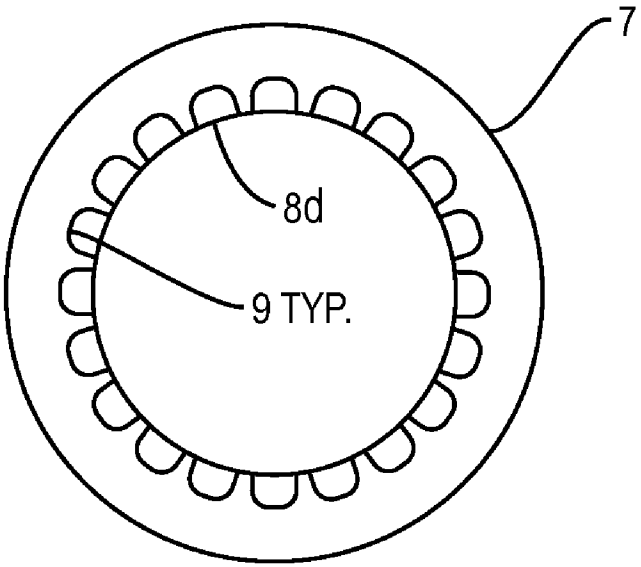
FIGS. 2A and 2B are alternative embodiments of a cross section view, from the downstream side, of a housing at the comminutor section of an inducer comminutor device housing, illustrating hard edges which when sweep by rotating blades causes a crushing and shearing of solids being transported by fluid flow.
Figure 2A:
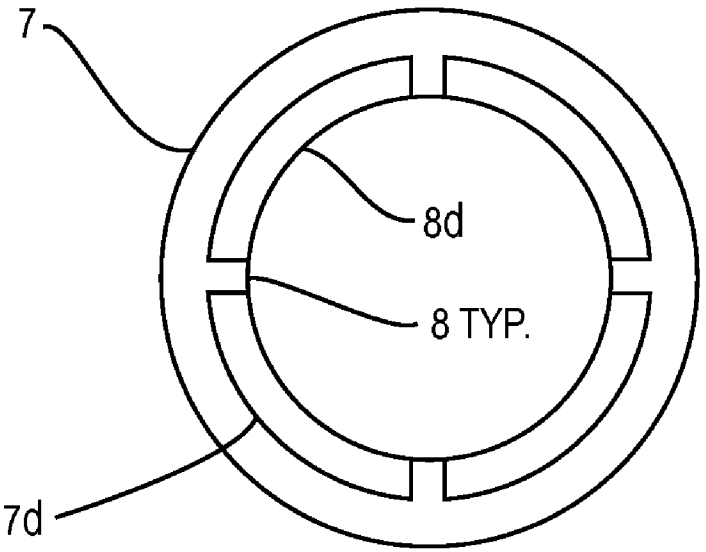

Referring to FIGS. 2A and 2B, there is illustrated a cross section view of one embodiment of comminutor section (7) configured with vanes (8), and an alternative embodiment of comminutor section (7) with channels (9). In FIG. 2A, comminutor section (7) has a full inside comminutor section diameter (7*d*) defined by the wall of the section, and a smaller vane diameter (8*d*) defined by the shearing edge of vanes (8). Vanes (8) may be fabricated as discreet components and secured within comminutor section (7) housing, or otherwise be provided by commonly known means. The spaces between vanes (8) and the wall of the comminutor section of FIG. 2A, and likewise the channels (9) of FIG. 2B, form or define fluid flow passages. In either or other embodiments, vanes or channels may be of other numbers and have different cross sections, and be either linear or helical in nature with the same or opposite direction of rotation as rotor blades (2), and have a uniform or varying pitch angle, which may be describable as yet another polynomial function.

There are other variations and examples of the invention. For example, one includes a hub that is partially straight and partially tapered. Some may have a rotor blade or blade set of constant cord or width, while others have blades that taper from end to end in with, which may offset the hub taper so as to result in a rotor of constant diameter over its length. Yet other embodiments may include a rotor of tapered or varying diameter with various combinations of hub and rotor blades, the tapers of either or both of which are describable as polynomial functions. For still other embodiments, cut-outs, slits, teeth, or equivalent structural variations to blade shape or edge profile that introduce additional striking surface at or near the outer edge of the blade that will engage solids and provide additional rending or shearing action, are optional. The number, shape and placement of such variations in blade edges is variable. As merely one example, cut-outs may be repeated in a continuous, relatively coarse or fine saw tooth pattern along the outer edge of each blade. For some embodiments, hardened inserts or surface treatments may also be applied to the cut-outs and/or the vanes and blade edges.

As still another example, multiple individual rotor blades of shorter length may be arranged over the length of the hub, or vanes within the comminutor section, where the pitch angle of an individual blade or vane is a function of yet still another polynomial function defining the pitch angle of the blades or vanes over the length of the hub or comminutor section. As one example, the leading edge of one blade or vane may be proximate the trailing edge of another blade or vane whereby solids sliding off the trailing edge of one blade or vane impinge on the leading edge of the next blade or vane.

Another embodiment of the invention includes a return bypass passage or network of passages from the outlet to the inlet routed through or around the housing, functioning in response to pressure differential between the inlet and outlet to avoid or reduce low flow pulsations. Yet another embodiment includes a housing configured as or with an abrasion resistant liner within a ductile outer housing, which may promote a safer, more reliable operation or a more repairable device, such as for when handling materials that may be highly abrasive, or otherwise detrimental to some materials.

The invention is susceptible of other and numerous embodiments. For example, There is an inducer comminutor device for a solids-bearing, fluid handling system consisting of a housing with an inducer section and a comminutor section. The housing is adaptable for installation in a fluid flow upstream of a main pump impeller such that the comminutor section is positioned between the inducer section and the main pump impeller. A rotor is disposed within the housing so as to occupy the comminutor section and the inducer section. The rotor has a hub and at least one rotor blade helically disposed thereon with an inlet and an outlet end and a blade pitch angle progressively increasing in pitch angle from the inlet to the outlet as a first polynomial function. The hub has a larger diameter at the outlet than the hub diameter at the inlet, the change in hub diameter from the inlet to the outlet being describable by a second polynomial function. The rotor and the housing together define a total fluid flow passageway.

The arc of the rotor blade rotation defines a rotor diameter. The comminutor section has a comminutor wall defining a comminutor section diameter, with inwardly extending vanes depending from the wall that a vane edge diameter or cage within which the rotor blade rotates. The inducer section has an inducer diameter, and vane diameter and the inducer diameter must be sufficiently larger than the rotor diameter to accommodate the rotor and its rotation without mechanical interference, while being sufficiently close in size to the rotor diameter so that rotating rotor blades sweeping past vane edges produces a crushing and shearing action on such solids as may migrate into position between them.

The rotor hub and walls of the rotor blade form at least one individual inducer fluid flow passages. The vanes and the wall of the comminutor section form individual comminutor fluid flow passages. The rotor blades may have at least one cut-out on an outer edge of the blade in the comminutor section so that solids transported in a fluid flow through the device and into position between the cutout and a vane edge are subjected to a further crushing and shearing action between a striking edge of the cut-out and the vanes. The cut-out may be step shaped and may have a radially oriented leading edge directed towards fluid flow.

There device may have a total sectional area of the fluid flow passageway measured on a plane normal to the meridional plane of the device at the outlet that is greater than a sectional area of a throat of the downstream impeller passage. The smallest sectional area of any individual fluid flow passage may be less than the sectional area of the throat of the downstream impeller passage. There may in some embodiments be fluid flow bypass connecting the outlet end of the fluid flow passageway back to the inlet end of the fluid flow passageway. The volumetric flow rate exiting the inducer comminution device is equal to or greater than flow requirements of the downstream main pump impeller. The rotor diameter may or may not be uniform over the length of the rotor. The vane diameter may or may not be uniformly equal over its length to the inducer section diameter.

Those skilled in the art will readily appreciate the nature and scope of the applications to which the invention may be directed. The invention and embodiments and examples thereof extends to variations of the terms used to describe its functionality, and to the details of the elements of the embodiment presented, as well as to the appended claims and equivalents thereof.

We claim:

1. An inducer comminutor device for a solids-bearing, fluid handling system, comprising:

a housing comprising an inducer section and a comminutor section, the inducer section containing an inducer therein and the comminutor section containing a comminutor therein, said housing having and inlet and an outlet, and being adapted for installation in a fluid flow upstream of a main pump impeller, whereby the comminutor is positioned between the inducer and the main pump impeller; and a rotor disposed within the housing so as to occupy both the comminutor section and the inducer section, a first portion of said rotor being a constituent component of the inducer and a second portion of said rotor being a constituent component of the comminutor, said rotor comprising a hub and at least one rotor blade helically disposed thereon, the at least one rotor blade having a blade pitch angle progressively increasing in pitch angle from the inlet to the outlet as a first polynomial function, the rotor having a cross-section spacing from blade to blade which increases from the inlet to the outlet, the hub having a larger diameter at the outlet than the hub diameter at the inlet, the change in hub diameter from the inlet to the outlet being describable by a second polynomial function; said inducer and said comminutor defining a total fluid flow passageway through which fluid and solids transported thereby can flow from the inlet to the outlet, the solids being reduced in size by the comminutor during passage there through without separation of the fluid from the solids.

2. The inducer comminutor device of claim 1: further comprising a rotating arc of said at least one rotor blade defining a rotor diameter;

the comminutor section having a comminutor wall defining a comminutor wall diameter, and inward extending vanes depending from the comminutor wall defining a vane diameter, the inducer section having an inducer wall diameter, the vane diameter and the inducer wall diameter being sufficiently larger than the rotor diameter to accommodate said rotor and rotation thereof without mechanical interference, the vane diameter being sufficiently close to the rotor diameter whereby rotating said rotor blades sweeping past said vanes comprise a crushing and shearing action on such solids as may enter therebetween; and said hub and said at least one rotor blade comprising individual inducer fluid flow passages; said vanes and said comminutor wall comprising individual comminutor fluid flow passages.

3. The inducer comminutor of claim 2, wherein at least one blade comprises at least one cut-out on an outer edge of the blade in the comminutor section whereby solids transported in a fluid flow through the device are subjected to a crushing and shearing action between a striking edge of said cut-out and said vanes.

4. The inducer comminutor device of claim 3, said at least one cut-out being step shaped with a radially oriented leading edge directed towards fluid flow.

5. The inducer comminutor device of claim 4, further comprising a total sectional area of the fluid flow passageway measured on a plane normal to the meridional plane of the device at the outlet being greater than a sectional area of a throat of an impeller passage of the downstream main pump impeller, and the smallest sectional area of any individual said fluid flow passage being less than the sectional area of the throat of the downstream impeller passage.

6. An inducer comminutor device for a solids-bearing, fluid handling system, comprising:

a housing comprising an inducer section and a comminutor section, the inducer section containing an inducer therein and the comminutor section containing a comminutor therein, said housing having and inlet and an outlet, and being adapted for installation in a fluid flow upstream of a main pump impeller, whereby the comminutor is positioned between the inducer and the main pump impeller;

a rotor disposed within the housing so as to occupy both the comminutor section and the inducer section, a first portion of said rotor being a constituent component of the inducer and a second portion of said rotor being a constituent component of the comminutor, said rotor comprising a hub and at least one rotor blade helically disposed thereon, the at least one rotor blade having a blade pitch angle progressively increasing in pitch angle from the inlet to the outlet as a first polynomial function, the rotor having a cross-section spacing from blade to blade which increases from the inlet to the outlet, the hub having a larger diameter at the outlet than the hub diameter at the inlet, the change in hub diameter from the inlet to the outlet being describable by a second polynomial function;

said inducer and said comminutor defining a total fluid flow passageway through which fluid and solids transported thereby can flow from the inlet to the outlet, the solids being reduced in size by the comminutor during passage there through without separation of the fluid from the solids;

a rotating arc of said at least one rotor blade defining a rotor diameter;

the comminutor section having a comminutor wall defining a comminutor wall diameter and inward extending vanes depending from the comminutor wall defining a vane diameter, the inducer section having an inducer wall diameter, the vane diameter and the inducer wall diameter being sufficiently larger than the rotor diameter to accommodate said rotor and rotation thereof without mechanical interference, the vane diameter being sufficiently close to the rotor diameter whereby rotating said rotor blades sweeping past said vanes comprise a crushing and shearing action on such solids as may enter there between;

said hub and said blades comprising individual inducer fluid flow passages;

said vanes and the wall of said comminutor section comprising individual comminutor fluid flow passages;

said at least one blade comprising at least one step shaped cut-out on an outer edge of the blade in the comminutor section whereby solids transported in a fluid flow through the device are subjected to a further said crushing and shearing action between a striking edge of said cut-out and said vanes; and said device further comprising a total sectional area of the fluid flow passageway measured on a plane normal to the meridional plane of the device at the outlet being greater than a sectional area of a throat of an impeller passage of the downstream main pump impeller, and the smallest sectional area of any individual said fluid flow passage being less than the sectional area of the throat of the downstream impeller passage.

7. The inducer comminutor device of claim 6, said rotor being mounted on a common shaft with said main pump impeller.

8. The inducer comminutor device of claim 6: said at least one rotor blade being multiple rotor blades.

9. The inducer comminutor device of claim 6, further comprising a fluid flow bypass connecting an outlet end of the fluid flow passageway with an inlet end of the fluid flow passageway.

10. The inducer comminutor device of claim 6, further comprising a liner within said housing.

11. The inducer comminutor device of claim 6, wherein a volumetric flow rate exiting the inducer comminutor device is equal to or greater than flow requirements of the downstream main pump impeller.

12. The inducer comminutor device of claim 6, said rotor diameter being uniform over the length of the rotor.

13. The inducer comminutor device of claim 6, the vane diameter being equal to the inducer section diameter.

14. An inducer comminutor device for a solids-bearing, fluid handling system, comprising:

a housing comprising an inducer section and a comminutor section, the inducer section containing an inducer therein and the comminutor section containing a comminutor therein, said housing having and inlet and an outlet, and being adapted for installation in a fluid flow upstream of and coaxially with a main pump impeller, whereby the comminutor is positioned between the inducer and the main pump impeller;

a rotor disposed on a common shaft with the main pump impeller and located within the housing so as to occupy both the comminutor section and the inducer section, a first portion of said rotor being a constituent component of the inducer and a second portion of said rotor being a constituent component of the comminutor, said rotor comprising a hub and at least one rotor blade helically disposed thereon, the at least one rotor blade having a blade pitch angle progressively increasing in pitch angle from the inlet to the outlet as a first polynomial function, the rotor having a cross-section spacing from blade to blade which increases from the inlet to the outlet, the hub having a larger diameter at the outlet than the hub diameter at the inlet, the change in hub diameter from the inlet to the outlet being describable by a second polynomial function;

said inducer and said comminutor defining a total fluid flow passageway through which fluid and solids transported thereby can flow from the inlet to the outlet, the solids being reduced in size by the comminutor during passage there through without separation of the fluid from the solids;

a rotating arc of said at least one rotor blade defining a rotor diameter;

the comminutor section having a comminutor wall defining a comminutor wall diameter and inward extending vanes depending from the comminutor wall defining a vane diameter, the inducer section having an inducer wall diameter, the vane diameter and the inducer wall diameter being sufficiently larger than the rotor diameter to accommodate said rotor and rotation thereof without mechanical interference, the vane diameter being sufficiently close to the rotor diameter whereby rotating said rotor blades sweeping past said vanes comprises a crushing and shearing action on such solids as may enter therebetween ; and the at least one blade comprises at least one step cut-out on an outer edge of the blade in the comminutor section whereby solids transported in a fluid flow through the device are further subjected to said crushing and shearing action between a striking edge of said cut-out and said vanes.

15. The inducer comminutor device of claim 14:

said hub and said blades forming at least one individual inducer fluid flow passage;

said vanes and the wall of said comminutor section forming individual comminutor fluid flow passages; and said device further comprising a total sectional area of the fluid flow passageway measured on a plane normal to the meridional plane of the device at the outlet being greater than a sectional area of a throat of an impeller passage of the downstream main pump impeller, and the smallest sectional area of any said fluid flow passage being less than the sectional area of the throat of the downstream impeller passage.

16. The inducer comminutor device of claim 14: said at least one rotor blade being multiple rotor blades.

17. The inducer comminutor device of claim 14, further comprising a fluid flow bypass connecting an outlet end of the fluid flow passageway with an inlet end of the fluid flow passageway.

18. The inducer comminutor device of claim 14, further comprising a liner within said housing.

19. The inducer comminutor device of claim 14, wherein a volumetric flow rate exiting the inducer comminutor device is equal to or greater than flow requirements of the downstream main pump impeller.

20. The inducer comminutor device of claim 14, the rotor diameter being uniform over the length of the rotor, the vane diameter being equal to the inducer section diameter.

* * * * *